US005873185A

United States Patent [19]

Harris et al.

[11] Patent Number: 5,873,185

[45] Date of Patent: Feb. 23, 1999

[54] SHOE GUARD

[76] Inventors: Cordell Harris, 5734 Jefferson St., Apt. A, Philadelphia, Pa. 19131; Howard Pinkney, 938 S. 58th St., Philadelpha, Pa. 19143

[21] Appl. No.: 14,208

[22] Filed: Jan. 28, 1998

[51] Int. Cl.[6] ..... A43B 23/30; A43B 13/22

[52] U.S. Cl. ..... 36/72 R; 36/7.2; 36/131

[58] Field of Search ..... 36/7.1 R, 7.2, 36/9 R, 72 R, 100, 101, 131

[56] References Cited

U.S. PATENT DOCUMENTS

| | | | |
|---|---|---|---|
| 1,382,748 | 6/1921 | Slasor | 36/72 R |
| 2,436,187 | 2/1948 | Bestland | 36/72 R |
| 2,552,700 | 5/1951 | Watts | 36/72 R |
| 2,625,752 | 1/1953 | Kemp | 36/72 R |
| 3,812,606 | 5/1974 | Merola | 36/72 R |
| 4,665,633 | 5/1987 | Edgerton | 36/72 R |
| 4,825,563 | 5/1989 | Strongwater | 36/72 R |
| 5,165,182 | 11/1992 | Michael | 36/72 R |
| 5,566,476 | 10/1996 | Bertrand et al. | 36/72 R |

*Primary Examiner*—M. D. Patterson
*Attorney, Agent, or Firm*—Paul & Paul

[57] ABSTRACT

A shoe guard is worn by an individual over a shoe for use to protect the shoe while the individual is riding a motorcycle. The shoe guard comprises a cover of sufficient size to be positioned over a portion of the shoe and is adaptable to be secured to the shoe, such as by straps.

22 Claims, 2 Drawing Sheets

SHOE GUARD

BACKGROUND OF THE INVENTION

1. Field of the Invention

The present invention relates generally to protective devices to be worn over shoes for the purpose to prevent or inhibit damage to the shoes and more particularly to protective devices worn over shoes for the purpose to inhibit or prevent damage to the shoes caused from riding a motorcycle.

2. Brief Description of the Prior Art

Motorcycles have been used over the years for a variety of different purposes. For example, motorcycles have long been favored by the military as well as by local and federal policing authorities due to the smaller size and improved maneuverability over larger sized vehicles. In recent years, motorcycle use by the general public has significantly increased, which is reflected by a 1995 census of 25 million registered motorcycles in the United States. Motorcycles are used by both men and women of all ages as both a means for transportation as well as for sport and enjoyment.

It has been observed that motorcycle riding can be damaging to both the appearance and structural integrity of shoes. For example, most motorcycles include a gear shift positioned near one pedal which is displaced by a rider's foot in order to change between a number of different gears. Typically, changes to a higher gear are made by moving the rider's foot in an upward direction so that the top of the foot first engages and then lifts the gear shift, while changes to a lower gear are made by movement of the rider's foot in a downward direction so that the lower portion of the foot engages and moves the gear shift downward. As most motorcycle riders for either safety or comfort reasons wear shoes when riding, the engagement with the gear shift is made by a rider's shoe, which can result with damage to the shoe; in particular, the upper portion of the shoe near the toe which is used to contact the gear shift to move the motorcycle into a higher gear. Most commercially available shoes are constructed having a durable lower surface or sole, while the remaining portions of a shoe are usually of a more delicate material than that used for the sole. As a result, damage ranging from dirt to abrasions or cuts can occur in the upper portion of the shoe near the toe due to contact with the gear shift. In addition, damage can also occur to other areas of the shoe; in particular, the inner portion of the shoe facing toward the motorcycle, which can result from impact with other portions of the motorcycle or from debris coming off the ground, such as dust or cinders.

There is a need for a protective covering that can be placed over shoes in order to protect the shoe from damage that can occur when riding a motorcycle.

SUMMARY OF THE INVENTION

The present invention provides a shoe guard adapted to be worn by an individual over a shoe for use to protect the shoe when the individual is riding a motorcycle. For this purpose, the present invention discloses a cover of sufficient size adapted for placement over at least a portion of an upper surface of a shoe and means for securing the cover to the shoe.

In accordance with the present invention, an object is to provide a novel cover adapted to be worn by an individual over a shoe in order to protect the shoe when riding a motorcycle.

These and other objects of the present invention will become more readily apparent when taken into consideration with the following description and the attached drawings.

DETAILED DESCRIPTION OF THE PREFERRED EMBODIMENTS

Figure 1:
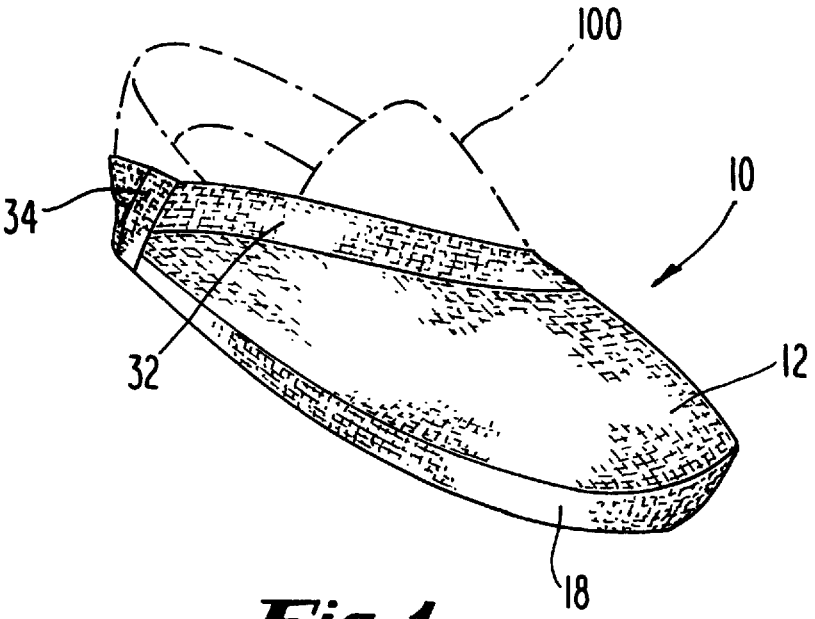
FIG. 1 is a perspective view of an embodiment of a shoe guard in accordance with the present invention shown mounted on a shoe in dotted lines.

Referring now to the drawings in detail, wherein like reference numerals indicate like elements throughout the several views, there is shown in the Figs. a shoe guard in accordance with an embodiment of the present invention. The shoe guard 10 is illustrated in FIGS. 1–4 in a secured position on a shoe 100 shown in dotted lines. In accordance with the present invention, the shoe 100 should be construed broadly to encompass any type of foot covering, such as boots, sandals, sneakers, dress shoes, work shoes, to name a few. The shoe guard 10 as is shown in the Figs., comprises, as portions thereof, a cover 12 and a means for securing the cover to the shoe, which in the present embodiment comprises three straps 14, 16 and 18, respectively, which are each generally elongated in shape and comprised of a substantially elastic material, such as the type used in elastic belts or used for the arm holes or around the waist of sports jackets.

The cover 12 in the present embodiment is defined by a perimeter having front and rear surfaces and opposing side surfaces. As illustrated in the FIG. 4, the first strap 14 is positioned proximate the front surface of the cover 12 and includes first and second ends which are attached to the opposing side surfaces of the cover 12 and with a mid-section detached from the cover 12 and engaging a lower portion of the shoe 100.

The second strap 16 is shown having a first end attached to the cover 12 proximate its rear surface and a second end attached to at least one and preferably both the cover 12 proximate its front surface and the first strap 14. In the present embodiment, the second strap 16 includes a mid-section that is detached from the cover 12 and is positioned adjacent to and preferably contacting at least a portion of the outer surface of the shoe 100.

Figure 3:
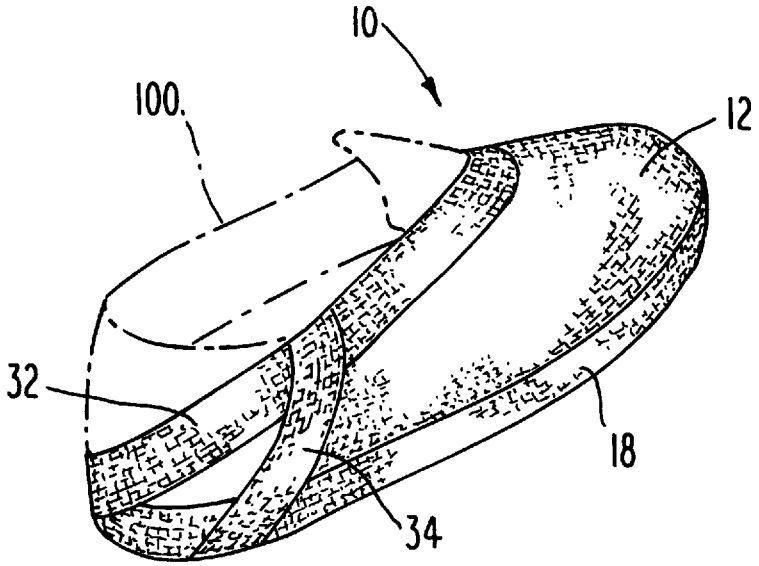
FIG. 3 is a right side perspective view of the shoe guard of FIG. 1.
Figure 4:
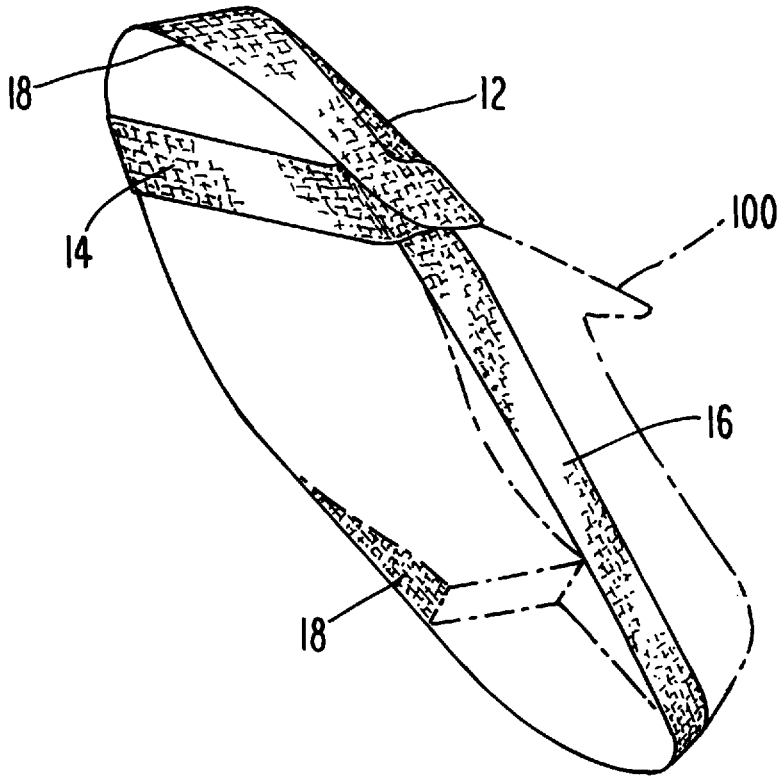
FIG. 4 is a bottom plan perspective view of the shoe guard of FIG. 1.

The third strap 18 in the present embodiment as shown in FIGS. 1 and 3 comprises a first end attached to the cover 12, proximate its front surface, which in the present embodiment is also attached to the first strap 14 as well as the second end of the second strap 16. The third strap 18 also has a second end attached to the cover 12 proximate its rear surface; and more particularly, in the present embodiment, the second end of the third strap 18 is also attached to the first end of the second strap 16. The third strap 18 further includes a mid-section which is attached to the cover 12 at its outer surface, which is preferably on an upper surface of the cover 12 in the present embodiment. In addition, in the present embodiment, the third strap 18 which is of a defined length is preferably attached to the outer portion of the cover 12 along substantially its entire length and positioned adjacent to the perimeter of the cover 12.

Figure 2:
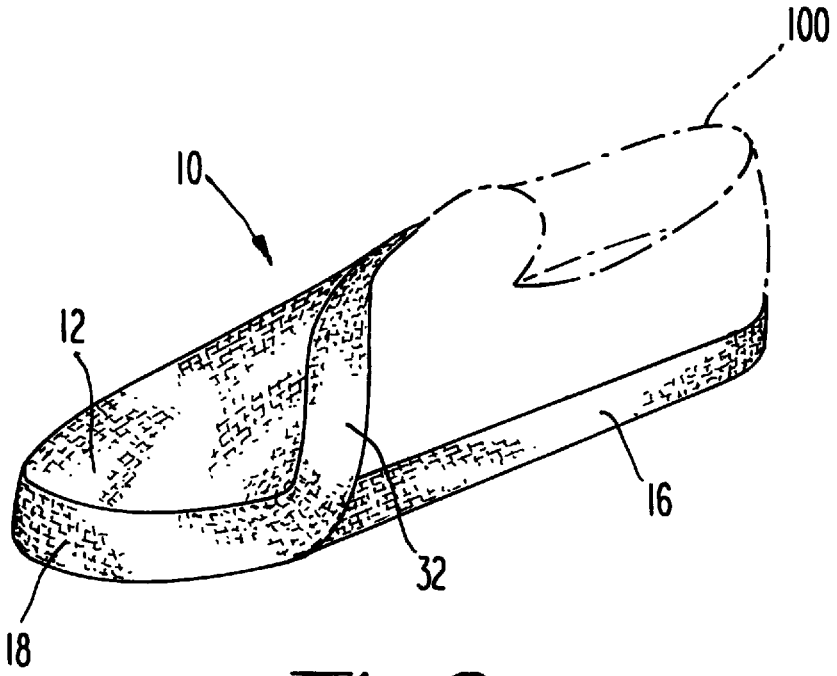
FIG. 2 is a left side perspective view of the shoe guard of FIG. 1.

In accordance with the present embodiment, the second and third straps 16 and 18 are preferably attached to each other at their ends defining a continuous strap portion and positioned adjacent to the perimeter of the cover 12. In addition, the first strap 14 is provided having its opposing ends attached at the perimeter of the cover 12 and to the continuous length of the second and third straps 16 and 18. In this embodiment, the securing means also includes fourth and fifth straps 32 and 34, respectively, which are each also generally elongated in shape and of a substantially elastic material. As best shown in FIGS. 2 and 3, the fourth strap 32 is attached at a first end to the second strap 16, attached at a second end to the third strap 18 and its mid-section attached to the cover 12 spaced from the second and third straps 16 and 18, respectively. The fifth strap 34 is attached at a first end to the fourth strap 32, at a second end to the third strap 18 and includes a mid-section attached to the cover 12. In a presently preferred embodiment, the first, second, third and fourth straps 14, 16, 18 and 32 are comprised a single length of strap, although as should be understood, this is not required.

As indicated above, the cover 12 in the present embodiment is defined by a perimeter having upper and lower surfaces, front and rear surfaces and opposing side surfaces. In the present embodiment, the cover 12 is of one-piece and sized to be positioned over substantially the upper portion of the shoe 100, substantially the inner portion of the shoe 100 and at least a part of the rear portion of the shoe 100. For this purpose, the cover 12 is formed having its inner surface substantially radiused inwardly in a direction toward the outer surface thereof and with the outer surface of the cover 12 being substantially radiused outwardly in the direction opposite the inner surface thereof. In this manner, the cover 12 is generally shaped in the form of a conventional shoe insole or, in more general terms, shaped similar to a question mark or candy cane. In this embodiment, preferably the cover 12 is comprised of a substantially elastic and sufficiently durable material, such as spandex, although any other suitable materials can be used for the same purpose. In accordance with the present invention, the upper surface of the cover 12 can be of any desired color or pattern(s) of color(s) and positioned upon the upper surface of the cover 12 or be formed as a part of the composition of the entire cover 12. In addition, where desired, any type of indicia can also be placed upon the upper surface of the cover 12; for example, such as a company or team name or logo.

The manner for which to place the shoe guard 10 upon a shoe of an individual will now be described. As discussed earlier, the shoe guard 10 is adapted to be worn over any type of shoe or similar foot covering. The shoe guard 10 can be used on shoes of different sizes, however, it is preferred that the shoe guard 10 be sized for a limited range of shoe sizes; for example, one shoe guard for sizes 6–8, another shoe guard for sizes 9–11 and still another shoe guard for sizes 12–14. The shoe guard 10 can be unisex with the same one used for both men and women or the shoe guard 10 can also be made so that one particular type be made specifically for women whereas another type specifically made for men.

In the present embodiment, it is preferred that the shoe guard 10 be placed on a shoe already positioned on an individual's foot, although the shoe guard 10 can also be placed on a shoe when not worn by an individual. Preferably, the shoe guard 10 is placed over the shoe by moving the shoe guard 10 in a direction from either below or in front of the shoe 100. For example, the front portion of the shoe 100 can first be inserted into the space between the front surface of the cover 12 and first strap 14, with the cover 12 then being positioned over the upper portion of the shoe and with the strap 14 being positioned against the lower portion or sole of the shoe 100. Thereafter, the remaining portions of the shoe guard are placed over shoe 100 into the position shown in the Figs. The elasticity of the cover 12 and first, second and third straps 14–18, as well as the fourth and fifth straps 32 and 34 in the present embodiment facilitate the process of placing the shoe guard 10 upon the shoe 100. Alternately, the shoe guard 10 can be placed upon the shoe 100 by first having the rear surface of the cover 12 and ends of the second and third straps 16 and 18 placed upon the rear portion of the shoe 100, with the remaining portions of the shoe then adjusted in the same manner described above and into the position shown in the Figs. As should be understood, the shoe guard 10 in accordance with the present embodiment can be placed upon the shoe in any desired manner.

The shoe guard 10 when positioned upon a shoe 100 in the manner shown in the Figs. is specifically adapted to prevent or at least inhibit damage to the shoe that can occur when the individual is riding a motorcycle. In particular, the shoe guard 10 is adapted so that its upper surface adjacent to its front surface will come into contact with the gear shift of the motorcycle when changing between gears while riding, accordingly protecting the integrity of the upper portion of the shoe proximate the front portion or toe. In addition, the cover 12 is positioned so that one side surface is adapted to be placed over substantially the entire inner portion of the shoe, which operates to protect the inner portion of the shoe from possible damage from either contact with a portion of the motorcycle or debris from the road when riding a motorcycle. As should be understood, while the shoe guard 10 is specifically adapted for use by an individual when riding a motorcycle, the shoe guard 10 can be used with similar vehicles as well, such as smaller motorbikes or mopeds or, where desired, a conventional bicycle; in particular, those bicycles which are formed having a pedal including a strap into which the front of the foot is inserted to retain the shoe on the pedal.

In view of that set forth above, it should be understood that there are several advantages to the shoe guard 10 of the present invention. One advantage is that it can be worn over any type of shoe in order to protect the shoe from damage that can occur from motorcycle riding; in particular, that can occur from either the gear shift or other part of the motorcycle or from debris coming from the road as well brush or other foliage either growing or positioned on the ground.

Another advantage of the shoe guard 10 of the present invention is that it can be comprised of a substantially elastic material which has the benefit that it makes it easier to place the shoe guard upon a shoe when worn by an individual. In addition, the elasticity of the shoe guard allows it to be used with more than one specific shoe size. In addition, another advantage is that the shoe guard can be made from inexpensive materials and by a relatively simple manufacturing process; in particular, the first, second, third, fourth and fifth straps 14, 16, 18, 32 and 34 are each preferably attached by being sewn directly to the cover 12, although other suitable means of attachment can also be used, such as a liquid adhesive, Velcro, snap or suitable staple type of fastening device.

It will be recognized by those skilled in the art that changes may be made by the above-described embodiments of the invention without departing from the broad inventive concepts thereof. For example, in the preferred embodiment of the present invention, while the cover 12 is of one-piece and sized to be positioned over substantially the upper portion of the shoe, which is the portion of the shoe in which the front of the foot is received, as well as positioned over substantially the inner portion of the shoe, which is the portion covering the inner part of the foot, and a part of the rear portion of the shoe, it should be understood that the cover 12 can also be comprised of a plurality of separate pieces attached together by additional straps or attachable by Velcro or similar material and/or sized to be positioned over additional or different portions of a shoe. In addition, another possible modification is that the cover 12 can be provided of more durable materials, such as Neoprene, in order to be adapted to be worn directly on the foot without any shoe. It is understood, therefore, that this invention is not limited to the particular embodiments disclosed, but it is intended to cover all modifications which are within the scope and spirit of the invention as defined by the appended claims.

We claim:

1. A shoe guard adapted to be worn by an individual over a shoe for use to protect the shoe when the individual is riding a motorcycle, whereby the shoe is defined by front and rear portions, upper and lower portions, and inner and outer portions, with said inner portion of said shoe being positioned toward the motorcycle and the outer portion of the shoe being positioned away from the motorcycle, and the motorcycle includes a gear shift that the individual engages with the upper portion of the shoe in order to change between a plurality of gears, said shoe guard comprising:

a cover means defining a perimeter having front and rear surfaces and opposing inner and outer side surfaces to place over at least a portion of said upper surface of said shoe for contacting said gear shift of said motorcycle ; and means for securing said cover means to said shoe;

wherein said cover means comprises a cover and said securing means comprises means attached to said cover proximate said front surface for placement against said lower portion of said shoe and means attached to said cover proximate to both said front and rear surfaces for placement against said outer surface of said shoe, wherein said securing means further comprises first and second generally elongated straps each comprising first and second ends and a mid-section, with said first and second ends of said first generally elongated strap fixed to said inner and outer surfaces of said cover proximate said front surface and said mid-section of said first generally elongated strap being at spaced separation from said cover, and with said first end of said second generally elongated strap attached to said cover proximate said rear surface said second end of said second generally elongated strap attached to at least one of said first generally elongated strap and said cover proximate said front surface and said mid-section of said second generally elongated strap being at spaced separation from said cover.

2. A shoe guard according to claim 1, wherein said securing means further comprises a third generally elongated strap defining first and second ends and a mid-section, with said first end of said third generally elongated strap attached to said cover proximate said front surface, said second end of said third generally elongated strap attached to said cover proximate said rear surface, and said mid-section of said third generally elongated strap being at spaced separation from said first generally elongated strap.

3. A shoe guard according to claim 2, wherein said inner surface of said cover is substantially curved inwardly in a direction toward said outer surface and said outer surface of said cover is substantially curved outwardly in a direction opposite said inner surface, and wherein said mid-section of said second generally elongated strap is detached from said cover and at spaced separation from said third generally elongated strap and said mid-section of said third generally elongated strap is attached to said cover at the outer portion of said cover, wherein said third generally elongated strap is attached to said outer portion of said cover along substantially an entire length of said third generally elongated strap.

4. A shoe guard according to claim 2, wherein said securing means further comprises a fourth generally elongated strap defining first and second ends and a mid-section, with said first end of said fourth generally elongated strap attached to said first end of said second strap, said second end of said fourth generally elongated strap attached to said second end of said third strap, and said mid-section of said fourth generally elongated strap attached to said cover opposite said third strap, wherein said cover extends between said third and fourth generally elongated straps.

5. A shoe guard according to claim 4, wherein said fourth generally elongated strap has said first end fixed to said first end of said second strap and said second end of said fourth generally elongated strap is fixed to said second end of said third strap.

6. A shoe guard according to claim 5, wherein said first, second, third and fourth generally elongated straps comprise a single strap.

7. A shoe guard according to claim 6 further comprising a fifth generally elongated strap defining first and second ends and a mid-section, with said first end of said fifth generally elongated strap attached to said fourth strap, said second end of said fifth generally elongated strap attached to said third strap and said mid-section of said fifth generally elongated strap attached to said cover.

8. A shoe guard according to claim 7, wherein said cover and at least one of said first, second, third, fourth and fifth generally elongated straps are each substantially elastic.

9. A shoe guard for use by an individual to wear over a shoe in order to protect the shoe from external damage comprising:

a generally elongated cover defining a perimeter having a front surface, a rear surface and opposing side surfaces;

a first generally elongated strap having first and second ends and a mid-section, with said first and second ends attached to said opposing side surfaces of said cover proximate said front surface of said cover, and said mid-section of said first generally elongated strap being at spaced separation from said cover;

a second generally elongated strap defining first and second ends and a mid-section, with said first end of said second generally elongated strap attached to said cover proximate said rear surface of said cover, said second end of said second generally elongated strap attached to at least one of said cover proximate said front surface thereof and said first generally elongated strap, and said mid-section of said second generally elongated strap being positioned closer to an inner surface than to an outer surface of said cover and at spaced from said cover; and a fourth generally elongated strap defining first and second ends and a mid-section, with said first end of said fourth generally elongated strap attached to said first end of said second generally elongated strap, said second end of said fourth generally elongated strap attached to said second end of said third strap, and said mid-section of said fourth generally elongated strap attached to said cover opposite said third strap, wherein said cover extends between said third and fourth generally elongated straps.

10. A shoe guard according to claim 9, wherein said shoe guard further comprises a third generally elongated strap defining first and second ends and a mid-section, with said first end of said third generally elongated strap attached to said cover proximate said front surface thereof, said second end of said third generally elongated strap attached to said cover proximate said rear surface thereof, and said mid-section of said third generally elongated strap being positioned closer to said outer surface than to said inner surface of said cover and at spaced separation from said first generally elongated strap.

11. A shoe guard according to claim 10, wherein said mid-section of said second generally elongated strap is detached from said cover and at spaced separation from said third generally elongated strap and said mid-section of said third generally elongated strap is attached to said cover at the outer portion of said cover.

12. A shoe guard according to claim 11, wherein said inner surface of said cover is substantially curved inwardly in a direction toward the outer surface of said cover and said outer surface of said cover is substantially curved outwardly in a direction opposite said inner surface of said cover.

13. A shoe guard according to claim 9, wherein said fourth generally elongated strap has said first end fixed to said first end of said second strap and said second end of said fourth generally elongated strap is fixed to said second end of said third strap.

14. A shoe guard according to claim 13, wherein said first, second, third and fourth generally elongated straps comprise a single strap.

15. A shoe guard according to claim 14 further comprising a fifth generally elongated strap defining first and second ends and a mid-section, with said first end of said fifth generally elongated strap attached to said fourth strap, said second end of said fifth generally elongated strap attached to said third strap and said mid-section of said fifth generally elongated strap attached to said cover.

16. In combination, a shoe guard and shoe, with the shoe guard being positioned over at least a portion of the shoe in order to protect the shoe from damage when worn by an individual riding a motorcycle, the combination comprising:

a shoe defining front and rear portions, upper and lower portions, and inner and outer portions;

a cover having a front surface, a rear surface and opposing inner and outer side surfaces positioned over at least a section of said upper portion of said shoe and a section of said inner portion of said shoe;

a first generally elongated strap having first and second ends and a mid-section, with said first and second ends fixed to said opposing side surfaces of said cover proximate said front surface of said cover and said mid-section engaging said lower portion of said shoe and at spaced separation from said cover;

a second generally elongated strap defining first and second ends and a mid-section, with said first end of said second generally elongated strap attached to said cover proximate said rear surface thereof, said second end of said second generally elongated strap attached to at least one of said cover proximate said front surface and to said first generally elongated strap, and said mid-section being positioned closer to said inner surface than to said outer surface of said cover engaging said outer portion of said shoe and at spaced separation from said cover; and a third generally elongated strap defining first and second ends and a mid-section, with said first end of said third generally elongated strap attached to said cover proximate said front surface thereof, said second end of said third generally elongated strap attached to said cover proximate said rear surface thereof, and said mid-section of said third generally elongated strap being positioned closer to said outer surface than to said inner surface of said cover adjacent to said inner portion of said shoe and at spaced separation from said first generally elongated strap.

17. The combination according to claim 14, wherein said mid-section of said second generally elongated strap is detached from said cover and at spaced separation from said third generally elongated strap and said mid-section of said third generally elongated strap is attached to said cover at the outer portion of said cover.

18. The combination according to claim 17, wherein said inner surface of said cover is substantially curved inwardly in a direction toward said outer surface of said cover and said outer surface of said cover is substantially curved outwardly in a direction opposite said inner surface of said cover, wherein said third generally elongated strap is attached to said outer surface of said cover along substantially an entire length of said third generally elongated strap and wherein said cover is of one-piece and positioned over substantially said upper portion of said shoe, substantially said inner portion of said shoe and a part of said rear portion of said shoe.

19. A shoe guard according to claim 16 further comprising a fourth generally elongated strap defining first and second ends and a mid-section, with said first end of said fourth generally elongated strap attached to said first end of said second strap, said second end of said fourth generally elongated strap attached to said second end of said third strap, and said mid-section of said fourth generally elongated strap attached to said cover opposite said third strap, wherein said cover extends between said third and fourth generally elongated straps, wherein said fourth generally elongated strap has said first end fixed to said first end of said second strap and said second end of said fourth generally elongated strap is fixed to said second end of said third strap, wherein said first, second, third and fourth generally elongated straps comprise a single strap.

20. A shoe guard according to claim 19, wherein said cover and at least one of said first, second, third fourth and fifth generally elongated straps is each substantially elastic.

21. A shoe guard according to claim 19 further comprising a fifth generally elongated strap defining first and second ends and a mid-section, with said first end of said fifth generally elongated strap attached to said fourth strap, said second end of said fifth generally elongated strap attached to said third strap and said mid-section of said fifth generally elongated strap attached to said cover.

22. The combination according to claim 21, wherein said cover and at least one of said first, second, third, fourth and fifth generally elongated straps is each substantially elastic.

* * * * *